US006966273B2

(12) United States Patent
Ross

(10) Patent No.: US 6,966,273 B2
(45) Date of Patent: Nov. 22, 2005

(54) ANCHOR FOR ANCHORING TO UNDERWATER STRUCTURES

(76) Inventor: David Ross, 574 Robin Rd., Morehead City, NC (US) 28557

( * ) Notice: Subject to any disclaimer, the term of this patent is extended or adjusted under 35 U.S.C. 154(b) by 0 days.

(21) Appl. No.: 10/794,819

(22) Filed: Mar. 8, 2004

(65) Prior Publication Data

US 2005/0193939 A1 Sep. 8, 2005

(51) Int. Cl.[7] ..... B63B 21/34
(52) U.S. Cl. ..... 114/297; 114/298
(58) Field of Search ..... 114/297, 298

(56) References Cited

U.S. PATENT DOCUMENTS

| | | | | |
|---|---|---|---|---|
| 877,761 A | * | 1/1908 | Cummings | 114/298 |
| 2,511,286 A | * | 6/1950 | Millen | 114/298 |
| 2,791,982 A | * | 5/1957 | Parry | 114/298 |
| 3,428,014 A | * | 2/1969 | Smith et al. | 114/298 |

* cited by examiner

*Primary Examiner*—Sherman Basinger

(74) *Attorney, Agent, or Firm*—John R. Ross, III; John R. Ross

(57) ABSTRACT

An anchor for anchoring a vessel to an underwater structure. The anchor includes a shaft and at least three inexpensive flukes each attached to the shaft with a tension adjustable release mechanism. In use at least one of the inexpensive flukes grapple onto a portion of the structure securing the vessel in place. If sufficient tension is applied to the anchor line connecting the anchor to the vessel the release mechanism releases the inexpensive fluke to free the anchor without damage to the underwater structure. In a preferred embodiment each of the release mechanisms includes a spring and a threaded bolt for placing the spring in compression by compressing the spring between the head of the bolt and a first end of a rod into which the bolt is screwed. The rod is contained within a tube. A tab on the inexpensive fluke fits into a slot at the second end of the rod and the tab is trapped in the slot by the inside surface of the tube. The fluke is released if sufficient tension is applied to the fluke to first overcome the compressive force applied by the bolt on the spring and second to extend the rod far enough outside the tube so that the tab on the fluke is no longer trapped by the inside surface of the tube. In a preferred embodiment the tension required for release can be adjusted from about 20 pounds to about 1000 pounds.

18 Claims, 3 Drawing Sheets

FIG. 5C
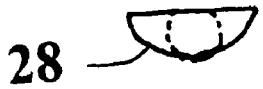
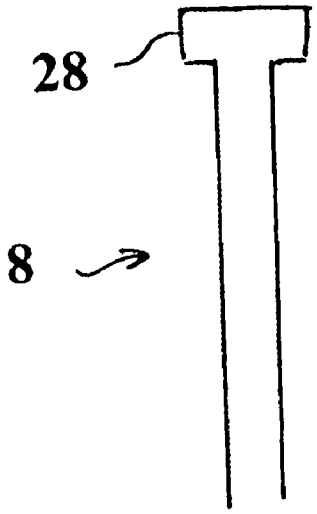
FIG. 5A
FIG. 5B
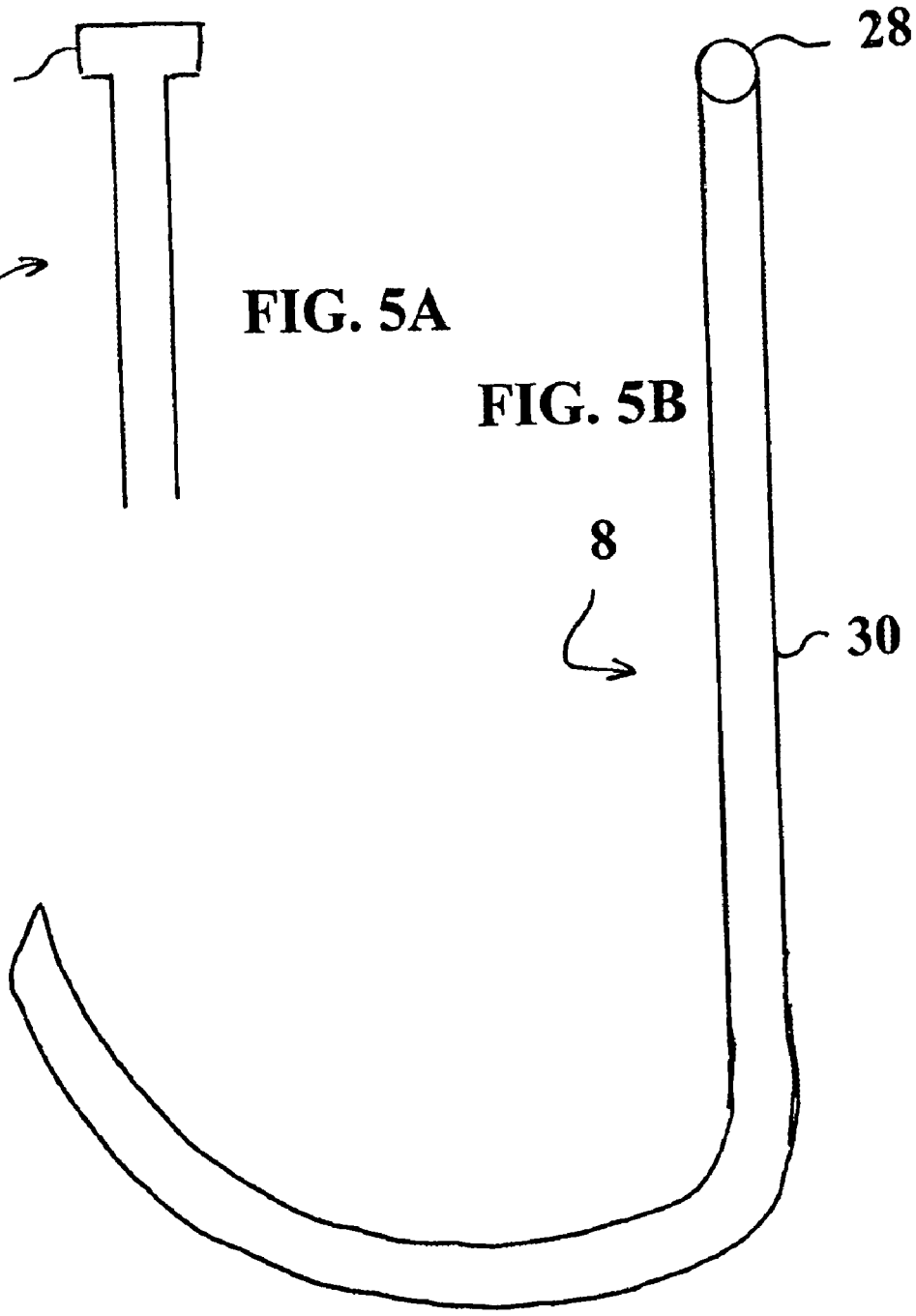

ANCHOR FOR ANCHORING TO UNDERWATER STRUCTURES

This application relates to anchors and in particular to anchors designed to temporarily attach boats to underwater structures.

BACKGROUND OF THE INVENTION

An anchor is a device used to attach a floating vessel to the water bottom or a fixed object on the water bottom for the purpose of holding the vessel in place. Anchors are connected to the vessel by ropes, cables or chains. Primitive anchors were heavy and relied on enormous weight and friction along underwater surfaces to hold a vessel. The structure of many modem anchors enables them to actually dig into the underwater surface and grip the sea, lake or riverbed powerfully against the drift of the vessel. The common anchor consists of a shaft, with a movable cross-piece called the stock at its top end, and at its bottom, two curved arms ending in spade-like points, called flukes. These common anchor designs are excellent for anchoring a vessel to a sandy or muddy bottom; however, they do not work very well when the bottom is a hard structure such as a wrecked ship or a corral reef. First, there is nothing for the spade-like flukes to dig into and second the anchor often gets tangled in the structure. When this latter situation occurs, the anchor often has to be cut loose, the line breaks, or a cleat is torn off causing damage to the boat in efforts to free the anchor. Also, if the anchor can be pulled free the underwater structure is often damaged. These common anchors are relatively expensive so the loss of an anchor can be a significant loss.

A grapnel is a relatively small anchor usually with four or five flukes and is used for grappling on to an underwater structure for the purpose of securing a vessel. These anchors work well at securing a vessel to an underwater structure such as a ship wreck or a corral reef, but often they also cannot be freed up when it is time to move on and as a result many are lost. Much damage can be done to a reef or boat in the course of freeing them from the structures when this is possible.

What is needed is an anchor for anchoring a vessel to an underwater structure which can be easily freed up and freed up without damage to the structure.

SUMMARY OF THE INVENTION

The present invention provides an anchor for anchoring a vessel to an underwater structure. The anchor includes a shaft and at least three inexpensive flukes each attached to the shaft with a tension adjustable release mechanism. In use at least one of the inexpensive flukes grapples onto a portion of the structure securing the vessel in place. If sufficient tension is applied to the anchor line connecting the anchor to the vessel the release mechanism releases the inexpensive fluke to free the anchor without damage to the boat or underwater structure and can save considerable time. In a preferred embodiment each of the release mechanisms includes a spring and a threaded bolt for placing the spring in compression by compressing the spring between the head of the bolt and a first end of a rod into which the bolt is screwed. The rod is contained within a tube. A tab on the inexpensive fluke fits into a slot at the second end of the rod and the tab is trapped in the slot by the inside surface of the tube. The fluke is released if sufficient tension is applied to the fluke to: first, overcome the compressive force applied by the bolt on the spring, and second, to extend the rod far enough outside the tube so that the tab on the fluke is no longer trapped by the inside surface of the tube. In a preferred embodiment the tension required for release can be adjusted from about 20 pounds to about 1000 pounds.

BRIEF DESCRIPTION OF THE DRAWINGS

FIGS. 5A, 5B and 5C are three views of an inexpensive fluke.

DETAILED DESCRIPTION OF PREFERRED EMBODIMENTS

A preferred embodiment of the present invention can be described by reference to the figures.

FIRST PREFERRED EMBODIMENT

Figure 1:
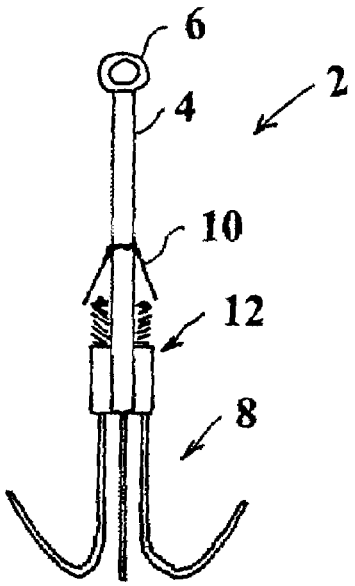
FIG. 1 is a drawing of a preferred embodiment of the present invention.

A first preferred embodiment of the present invention is shown as 2 in FIG. 1. It specially designed for anchoring small boats up to about 26 feet to underwater structures such as ship wrecks and corral reefs. The anchor includes shaft 4 comprised of a 2 foot long 1 inch diameter carbon steel rod. A steel ring 6 with a 1 inch inside diameter is welded to the top of shaft 4 for the attachment of an anchor line such as a rope to a vessel. The anchor has three inexpensive flukes 8 comprised of ⅜-inch diameter steel rods heat bent into the shapes shown. These flukes are attached to the shaft via release mechanisms 12.

Figure 2:
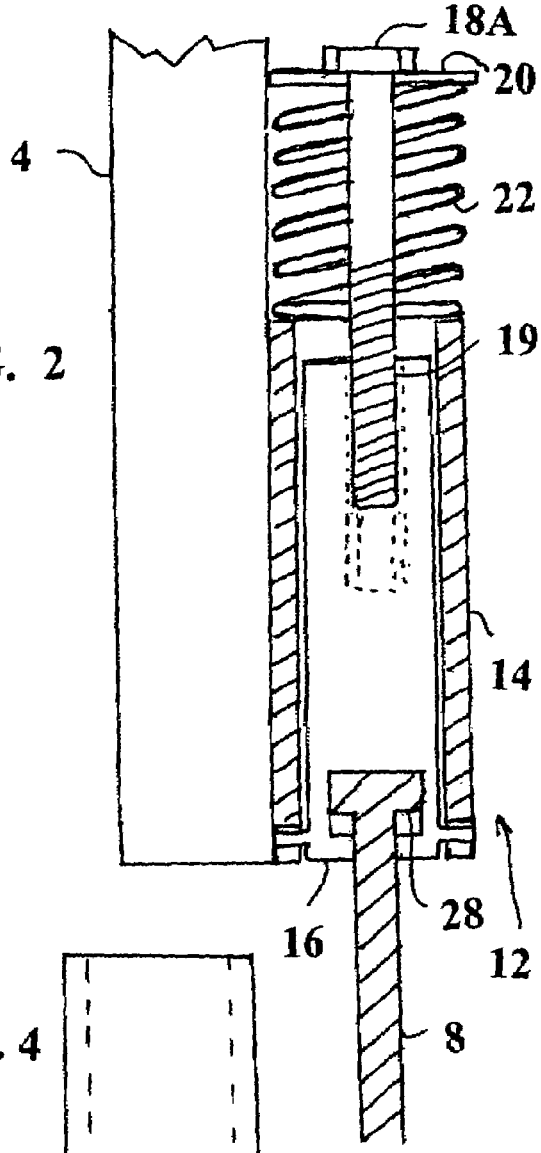
FIG. 2 is a drawing of a preferred release mechanism.
Figure 3A:
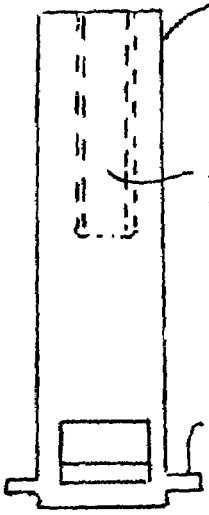
FIGS. 3A and 3B are drawings of a release rod.
Figure 3B:
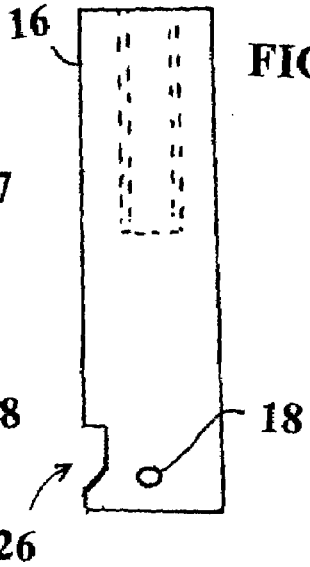
Figure 4:
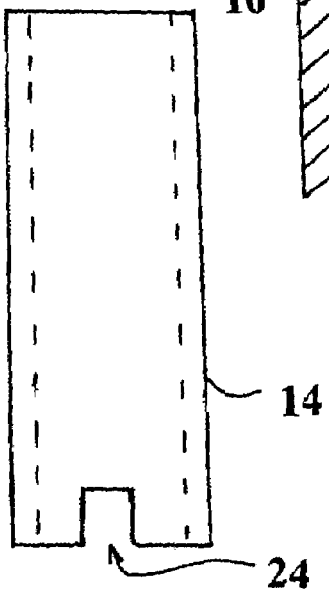
FIG. 4 is a drawing of a release tube.

Details of release mechanisms 12 are shown in FIG. 2. Each mechanism comprises 4 inch long release tube 14 with a 1 inch inside diameter. These tubes are welded to shaft 4 at the positions shown in FIGS. 1 and 2. A release rod 16 with diameter slightly smaller than 1 inch slides inside tube 14. This release rod comprises a threaded hole 17 at a first end and a 1¼ inch long, 3/16 inch diameter positioning pin 18 which is press fit through a hole in release rod 16 near the second end of rod 16 and also release slot 26 located near the second end of release rod 16. A tab 28 of fluke 8 is normally trapped in slot 26 by the inside surface of tube 14. Three views of fluke 8 are shown in FIGS. 5A, 5B and 5C. It is comprised of 3/16 inch diameter carbon steel and is about 1 foot long and is bent with heat into the shape shown in FIG. 5B. Tab 28 as shown in FIG. 5C is rounded to correspond to the inside surface of tube 14. Steel spring 22 is compressed by ¼ inch diameter, standard thread bolt 19 between tube 14 and the head 18A of bolt 19 and washer 20. Spring 22 for many applications preferably will have a spring constant of about 1000 pounds per inch. Therefore, screwing bolt 19 far enough into release rod 16 to compress spring 22 about ¼ inch will apply about 250 pounds of compression to spring 22. As a result release rod 16 will remain in the position shown in FIG. 2 until at least 250 pounds of tension is applied between fluke 8 and the vessel. If more than 250 pounds of tension are applied spring 22 will be compressed farther and release rod will begin sliding out of tube 14. Once rod 16 has slid about ⅛ inch (requiring an additional 125 pounds) tab 28 will no longer be trapped by the inside diameter of tube 14 and inexpensive fluke 8 will be released freeing anchor 2. Thus, with this design and the specified initial adjustment, 375 pounds of release tension is required to release the anchor. The compression length of spring 22 in this embodiment is about 1 inch. Thus, the release tension could be varied anywhere from about 125 pounds to about 1000 pounds by varying the initial adjustment of bolt 19.

Applicant believes the design described above is sufficient for boats up to about 26 feet. For boats much smaller than 26 feet, a spring with a smaller spring coefficient would be preferred and for much larger boats a heaver spring would be preferred.

OTHER EMBODIMENTS

Figure 6:
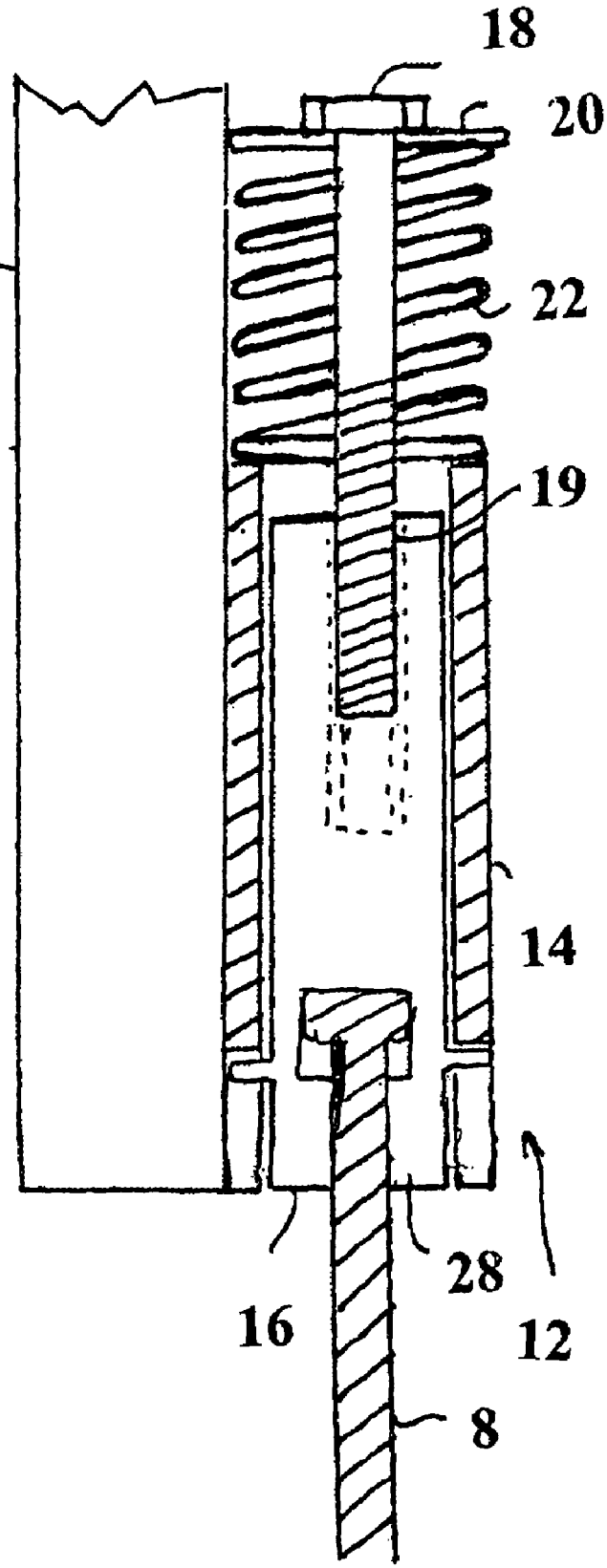
FIG. 6 shows a modified release mechanism.

The present invention has been described in terms of specific embodiments. However, persons skilled in this are will recognize that many modifications could be made to the designs described above using the basic principals of the invention. For example many other materials could be substituted for the materials specified. Materials more resistant to rust and other types of corrosion could be used. A conical shaped boot could be positioned on the shaft as shown as 10 in FIG. 1. The flukes could have many different shapes other than the one shown and could be made from a material which disintegrates over a period of a few months or a few years in salt water. As shown in FIG. 6, slot 24 could be made deeper and slot 26 positioned farther up inside tube 14 to provide a longer distance such as ¼ inch for release rod 16 to side before fluke 8 is released. This would mean that spring 22 would not have to be pre-compressed as much as in the FIG. 2 version for the same release tension. (For example in this case, only ⅛ inch of pre-compression plus the ¼ inch slide requirement would provide the same 375 pound release tension requirement.) Therefore, the reader should determine the scope of the invention from the appended claims and their legal equivalents and not by the specific embodiments described.

I claim:

1. An anchor for anchoring a vessel to an underwater structure comprising:

A) a shaft,

B) at least three tension adjustable release mechanisms attached to said shaft, each of said at least three tension adjustable mechanism comprising:

1) a release tube defining an inside surface, 2) a release rod comprising a threaded hole and a release slot, said rod being slidedly positioned within said release tube, 3) a spring, and 4) an adjustment bolt defining a head and threaded into said threaded hole for compressing said spring between said release tube and said head;

C) at least three flukes, each fluke releasably attached to one of the tension adjustable release mechanisms;

wherein said tension adjustable mechanisms are adjustable to permit release of said flukes upon application to said flukes of a predetermine tension within a desired range of tension.

2. The anchor as in claim 1 wherein said desired range of tension is from less than about 150 pounds to over 1000 pounds.

3. The anchor as in claim 1 and also comprising a washer positioned between said head and said spring.

4. The anchor as in claim 1 wherein each of said flukes comprises a tab positioned in said release slot and trapped within said release tube by said inside surface.

5. The anchor as in claim 1 wherein said release slot is located on said release rod so that a slide of a distance between about ⅛ inch to about ¼ inch will extend the slot far enough outside said release tube to permit release of said fluke.

6. The anchor as in claim 1 wherein said fluke is comprised of steel.

7. The anchor as in claim 1 wherein said fluke is comprised of a material chosen for it ability to disintegrate relatively rapidly in salt water.

8. The anchor as in claim 1 wherein said fluke is comprised of a non-corrosive material.

9. The anchor as in claim 1 and further comprising a conical shaped boot positioned on said shaft.

10. The anchor as in claim 1 and further comprising a ring attached to said shaft for attaching said anchor to said vessel via an anchor line.

11. An anchor for anchoring a vessel to an underwater structure comprising:

A) a shaft,

B) at least three tension adjustable release means attached to said shaft, wherein each of said tension adjustable release means comprises:

1) a release tube defining an inside surface, 2) a release rod comprising a threaded hole and a release slot, said rod being slidedly positioned within said release tube, 3) a spring, and 4) an adjustment bolt defining a head and threaded into said threaded hole for compressing said spring between said release tube and said head;

C) at least three flukes, each fluke releasably attached to one of the tension adjustable release means;

wherein said tension adjustable means are adjustable over to permit release of said flukes upon application to said flukes of a predetermine tension within a desired range of tension.

12. The anchor as in claim 11 wherein said desired range of tension is from less than about 150 pounds to over 1000 pounds.

13. The anchor as in claim 11 and also comprising a fender washer positioned between said head and said spring.

14. The anchor as in claim 11 wherein each of said flukes comprises a tab positioned in said release slot and trapped within said release tube by said inside surface.

15. The anchor as in claim 11 wherein said release slot is located on said release rod so that a slide of a distance between about ⅛ inch to about ¼ inch will extend the slot far enough outside said release tube to permit release of said fluke.

16. The anchor as in claim 11 wherein said fluke is comprised of steel.

17. The anchor as in claim 11 wherein said fluke is comprised of a material chosen for it ability to disintegrate relatively rapidly in salt water so that the anchor will be environmentally friendly.

18. The anchor as in claim 11 and further comprising a conical shaped boot positioned on said shaft.

* * * * *